US010669902B2

(12) United States Patent
Rommel et al.

(10) Patent No.: US 10,669,902 B2
(45) Date of Patent: Jun. 2, 2020

(54) VALVE DRIVE FOR AN INTERNAL COMBUSTION ENGINE

(71) Applicant: Mahle International GmbH, Stuttgart (DE)

(72) Inventors: Juergen Rommel, Burgstetten (DE); Christoph Steinmetz, Ludwigsburg (DE)

(73) Assignee: Mahle International GmbH (DE)

( * ) Notice: Subject to any disclaimer, the term of this patent is extended or adjusted under 35 U.S.C. 154(b) by 81 days.

(21) Appl. No.: 15/942,393

(22) Filed: Mar. 30, 2018

(65) Prior Publication Data

US 2018/0283240 A1 Oct. 4, 2018

(30) Foreign Application Priority Data

Mar. 31, 2017 (DE) ..... 10 2017 205 540

(51) Int. Cl.

| | |
|---|---|
| ***F01L 1/18*** | (2006.01) |
| ***F01L 13/00*** | (2006.01) |
| ***F01L 1/047*** | (2006.01) |
| *F01L 1/053* | (2006.01) |

(52) U.S. Cl.

CPC ..... *F01L 13/0036* (2013.01); *F01L 1/047* (2013.01); *F01L 1/18* (2013.01); *F01L 1/181* (2013.01); *F01L 1/053* (2013.01); *F01L 2013/101* (2013.01); *F01L 2013/103* (2013.01); *F01L 2013/105* (2013.01)

(58) Field of Classification Search

CPC ..... F01L 1/18; F01L 13/0036; F01L 1/047; F01L 1/181

USPC ..... 123/90.16, 90.18, 90.39, 90.44

See application file for complete search history.

(56) References Cited

U.S. PATENT DOCUMENTS 8,714,125 B2 * 5/2014 Kamichika ..... F01L 1/047 123/90.16

FOREIGN PATENT DOCUMENTS

| | | | |
|---|---|---|---|
| DE | 19945340 | A1 | 3/2001 |
| DE | 2005155555 | A | 6/2005 |
| DE | 102010032628 | A1 | 2/2012 |
| JP | S60-233306 | A | 11/1985 |

(Continued)

OTHER PUBLICATIONS

English abstract for DE-19945340.

(Continued)

*Primary Examiner* — Ching Chang

(74) *Attorney, Agent, or Firm* — Fishman Stewart PLLC

(57) ABSTRACT

A valve drive for an internal combustion engine may include a cam shaft including at least two cams rotationally attached thereto. The valve drive may also include a cam follower including a roller bolt including a rotatable roller arranged thereon. Additionally, the valve drive may include a lever device drivingly connected to the cam follower configured to adjust the cam follower between a first position and a second position. The valve drive may further include a rotatably supported control lever drivingly connected to the cam follower configured to adjust at least one valve of an internal combustion engine. The valve drive may include an actuator drivingly connected to the lever device configured to adjust the cam follower between the first position and the second position, the actuator may be connected to the cam follower in an articulated manner via the lever device.

20 Claims, 2 Drawing Sheets

(56) References Cited

FOREIGN PATENT DOCUMENTS

JP 2001207814 A 8/2001

OTHER PUBLICATIONS

English abstract for DE-102010032628.
English abstract for JP-2001207814.
English abstract for JP-2005155555.
English abstract for JP-S60-233306.

* cited by examiner

VALVE DRIVE FOR AN INTERNAL COMBUSTION ENGINE

CROSS-REFERENCE TO RELATED APPLICATIONS

This application claims priority to German Patent Application No. DE 10 2017 205 540.5, filed on Mar. 31, 2017, the contents of which are hereby incorporated by reference in its entirety.

TECHNICAL FIELD

The invention relates to a valve drive for an internal combustion engine as well as to an internal combustion engine comprising such a valve drive.

With the help of an adjustable valve drive, which comprises two or more cams of a different cam stroke, the cylinder of an internal combustion engine can be operated in two or more different operating modes.

BACKGROUND

Such a valve drive is known for example from DE 199 45 340 A1.

SUMMARY

It is an object of the present invention to show new ways when developing adjustable valve drives. In particular, a valve drive is to be created, which is characterized by a particularly simple constructive design as well as, in the alternative or in addition, by little need for installation space.

This object is solved by means of the subject matter of the independent claim(s). Preferred embodiments are the subject matter of the dependent claim(s).

It is thus the basic idea of the invention to adjust a cam follower of a valve drive with the help of a lever device, which, in turn, is controlled by an actuator. Such a lever device, which can be rotated about an axis of rotation, allows for the flexible positioning of the drive unit—the actuator—relative to the cam follower. Compared to conventional valve drives, an extensive sliding guide for adjusting the cam follower can in particular be forgone. Finally, the valve drive introduced here has a high mechanical stiffness, which turns out to be particularly advantageous in the long-term operation of the valve drive in an internal combustion engine.

A valve drive according to the invention comprises a cam shaft, to which at least two cams, preferably comprising a different cam stroke, are attached in a rotationally fixed manner. The valve drive further comprises a cam follower, which has a roller bolt, on which at least one roller is arranged so as to be rotationally adjustable relative to the roller bolt. According to the invention, provision is made for a lever device, which is drivingly connected to the cam follower, for adjusting the cam follower between a first position, in which the cam follower is drivingly connected to the first cam, and a second position, in which the cam follower is drivingly connected to the second cam. The valve drive also comprises a rotatably supported control lever, which is drivingly connected to the cam follower for controlling at least one valve of the internal combustion engine. An actuator for adjusting the cam follower between the first and the second position is drivingly connected to the lever device. For this purpose, the actuator is connected to the cam follower in an articulated manner by means of the lever device.

In the case of the valve drive according to the invention, which is introduced here, the cam follower of the valve drive can be adjusted between a first and a second position in a simple manner. The valve drive is thus suitable for a plurality of uses, in particular to control inlet and outlet valves of an internal combustion engine.

According to a preferred embodiment, the actuator is supported on the same axis as the control lever. This embodiment provides for a simple mechanical coupling of the actuator with the control lever.

In an advantageous further development, the control lever has a first accommodation, in which the axis is partially accommodated. The axis can be permanently mounted to the control lever in a stable manner by means of this measure.

Particularly preferably, the first accommodation is embodied as first aperture, through which the axis engages. The axis can be permanently mounted to the control lever in a stable manner by means of this measure as well.

In a preferred embodiment, the lever device is embodied as two-legged toggle lever comprising a first and a second leg. The two legs are thereby rigidly connected to one another via a toggle of the toggle lever and can be pivoted about an axis of rotation, which runs through the toggle. By means of a suitable embodiment and dimensioning of the toggle lever, this variation allows placing the actuator at a position, which is virtually arbitrary relative to the cam follower.

In an advantageous further development, the first leg is connected to the actuator in an articulated manner by means of a first joint, and the second leg is connected to the cam follower in an articulated manner by means of a second joint. This makes it possible to align the actuator and the cam follower independently from one another.

In another preferred embodiment, the actuator comprises a sleeve, which is arranged on the axis so as to be adjustable along the axial direction and to which the first joint is attached. Such a sleeve allows for an adjustable storage of the sleeve on the axis, which is also reliable during long-term operation.

In an advantageous further development, a first elongated hole is embodied on the first leg of the toggle lever for embodying the first joint. In this further development, a first protrusion, which protrudes from the sleeve, is guided in the first elongated hole. The adjusting mechanism required for the pivoting movement can be realized in a particularly simple manner in this way.

In an advantageous further development, a second elongated hole is embodied on the second leg of the toggle lever for embodying the second joint. In this embodiment, a second protrusion, which protrudes from the cam follower, preferably from the roller bolt, is guided in the second elongated hole. In this further development, the adjusting mechanism required for the pivoting movement is also realized in a particularly simple manner.

In an alternative variation of the above-mentioned further developments, the two legs can also be realized as extendable telescopic arms of variable length. The provision of elongated holes can be forgone in this case.

The lever device, preferably the toggle lever, can be adjusted between a first lever position, in which the cam follower is in the first position, and a second lever position, in which the cam follower is in the second position. A linear adjustment of the cam follower, in particular of the roller arranged on the roller bolt, is effected by means of such an assignment by a rotational movement of the lever device.

Particularly preferably, an axis of rotation of the control lever extends along the axial direction. Advantageously, the axis of rotation of the lever device extends perpendicular to the axis of rotation of the control lever. With the geometry associated with both measures, either alone or in combination, it is attained that the valve drive is constructed in a particularly compact manner, thus requires only very little installation space.

In an advantageous further development, the sleeve can be axially adjusted on the axis between a first sleeve position, in which the lever device, preferably the toggle lever, is in the first lever position, and a second sleeve position, in which the lever device, preferably the toggle lever, is in the second lever position. A rotational movement of the lever device is effected by means of such an assignment by a linear adjustment of the actuator.

In a further preferred embodiment, which can be realized particularly easily from a technical aspect, the roller is arranged on the roller bolt so as to be rotationally adjustable relative thereto along an axial direction of the roller bolt. In this alternative, the roller can further be adjusted in the axial direction between the first position of the cam follower, in which the roller is drivingly connected to the first cam, and the second position of the cam follower, in which the roller is drivingly connected to the second cam.

In another advantageous further development, the control lever has two second accommodations, in which the roller bolt is accommodated. The roller bolt can be supported permanently on the control lever in a stable manner in this way. Particularly preferably, the control lever is thus used to attach the axis as well as the roller bolt. This variation requires a particularly small number of components.

In an advantageous further development, the second accommodation is embodied as second aperture, through which the roller bolt engages. This measure also supports a stable fastening of the roller bolt on the control lever.

Advantageously, the second aperture is embodied in two fork arms, which are molded on the control lever. A space, in which the roller, which is provided on the roller bolt, is arranged, is thereby embodied between the two fork arms. This variation requires particularly little installation space.

Particularly preferably, the two legs form an obtuse angle with one another in a cross section perpendicular to the axis of rotation. Such a geometry allows for the attachment of the actuator at a slight distance to the cam follower.

In a further referred embodiment, the actuator has an actuator housing as well as an actuator element, which protrudes from the actuator housing and which can be adjusted between a retracted and an extended position. In this embodiment, the actuator element and the sleeve are matched to one another in such a way that the sleeve is in the first sleeve position when the actuator element is retracted and is in the second position when the actuator element is extended, or vice versa.

Particularly preferably, the first position of the actuator element is a position, which is maximally retracted into the actuator housing and/or the second position of the actuator element is a position, which is maximally extended from the actuator housing. In an alternative variation, the second position of the actuator element can be the position, which is maximally retracted into the actuator housing and/or the first position of the actuator element can be the position, which is maximally extended from the actuator housing.

In an advantageous further development, the valve drive comprises a housing part, on which the toggle lever is pivotably supported.

In a further advantageous further development, the valve drive comprises a pretensioning device, by means of which the actuator element is pretensioned towards the retracted or to the extended position.

Particularly advantageously, the pretensioning device can comprise a resilient element. In particular a tension or compression spring of a metal, preferably of steel, can be considered for this.

In a further preferred embodiment, the actuator is embodied as electrical actuator. Such an electrical actuator allows for an accurate adjustment of the actuator element between the retracted and the extended position.

The invention furthermore relates to an internal combustion engine comprising a valve drive as introduced above. The above-explained advantages of the valve drive according to the invention can thus also be transferred to the internal combustion engine according to the invention.

Further important features and advantages of the invention follow from the subclaims, from the drawings, and from the corresponding figure description by means of the drawings.

It goes without saying that the above-mentioned features and the features, which will be explained below, cannot only be used in the respective specified combination, but also in other combinations or alone, without leaving the scope of the present invention.

Preferred exemplary embodiments of the invention are illustrated in the drawings and will be explained in more detail in the description below, whereby identical reference numerals refer to identical or similar or to functionally identical components.

BRIEF DESCRIPTION OF THE DRAWINGS

In each case schematically.

DETAILED DESCRIPTION

Figure 1:
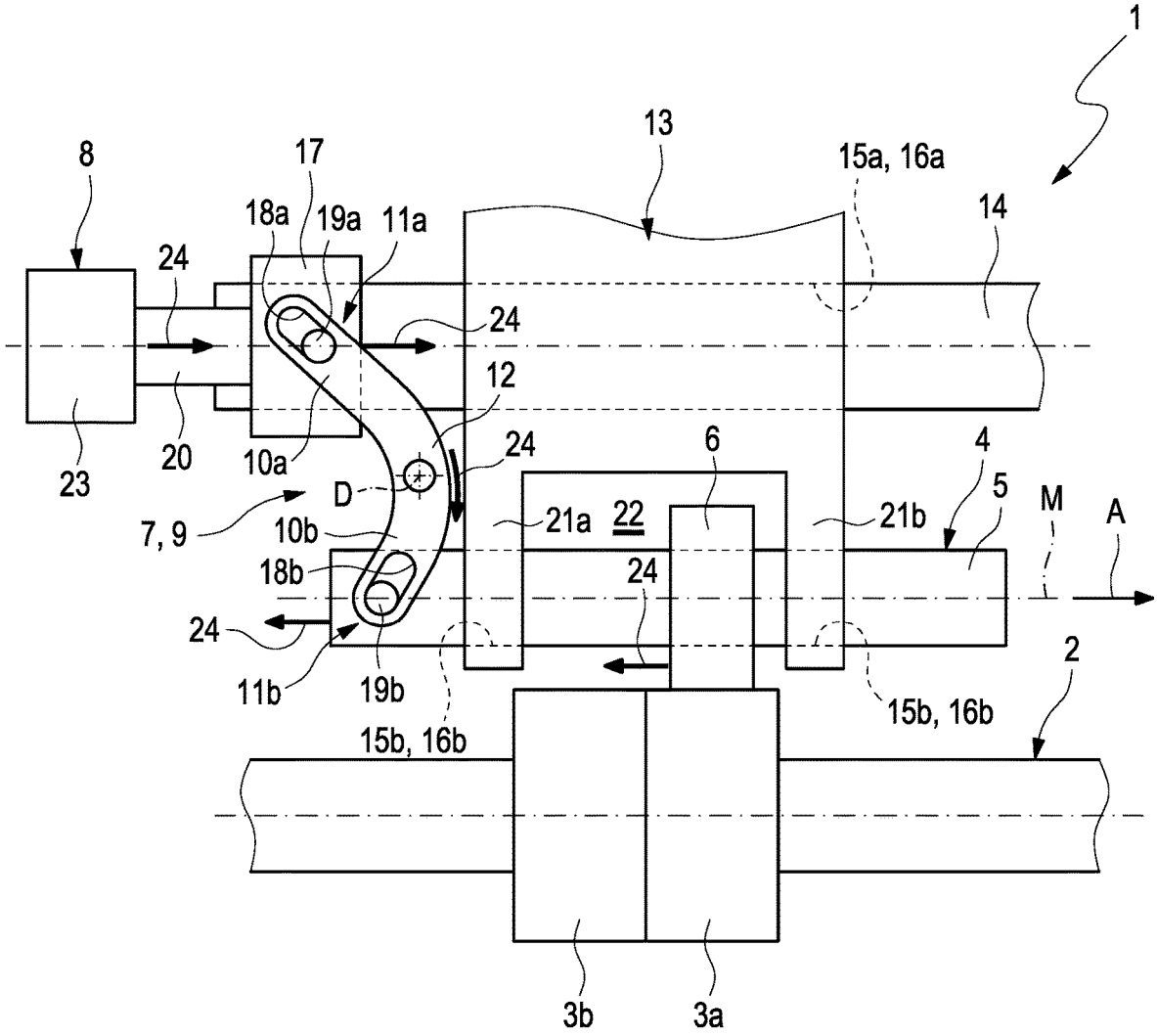
FIG. 1 shows an example of a valve drive according to the invention, in which the cam follower is in a first position, in which it is drivingly connected to a first cam, which is arranged on the cam shaft.
Figure 2:
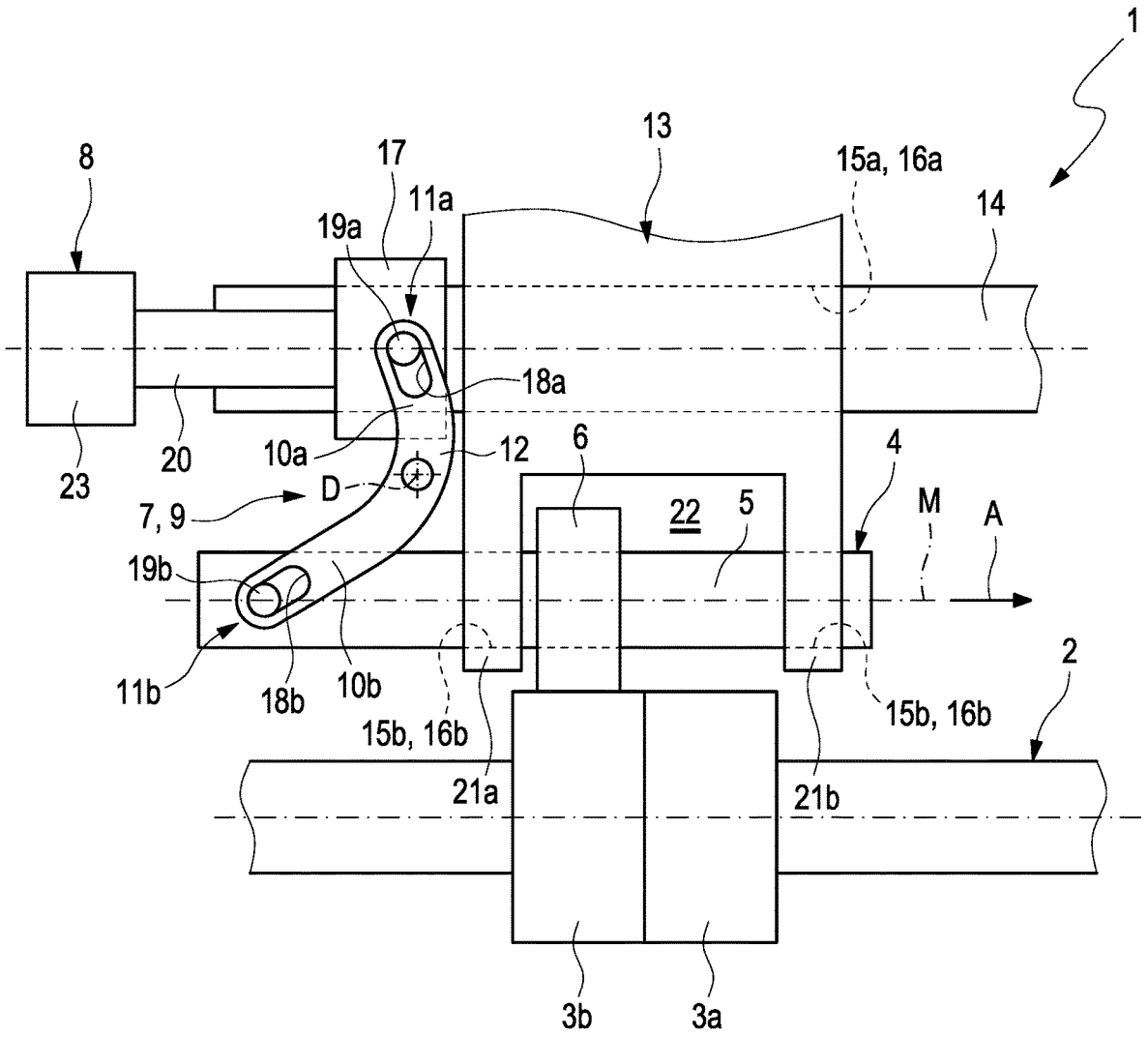
FIG. 2 shows the valve drive of FIG. 1 comprising the cam follower in a second position, in which it is drivingly connected to a second cam, which is arranged on the cam shaft.

FIGS. 1 and 2 illustrate an example of a valve drive 1 according to the invention. The valve drive 1 comprises a cam shaft 2, on which two cams 3*a*, 3*b* of a different cam contour or of a different cam stroke, respectively, are attached in a rotationally fixed manner. The valve drive further has a cam follower 4, which comprises a roller bolt 5. A roller 6 is arranged on the roller bolt 5. The roller 6 is embodied so as to be capable of being rotated relative to the roller bolt 5. The roller 6 and the roller bolt 5 can be adjusted jointly along an axial direction A of the roller bolt 5—which can be determined by the course of a longitudinal center axis M of the cylindrical roller bolt 5, namely between a first position of the cam follower 4, in which the roller 6 is drivingly connected to the first cam 3*a*, and a second position of the cam follower 4, in which the roller 6 is drivingly connected to the second cam 3*b*. FIG. 1 shows the cam follower 4 in the first position, FIG. 2 in the second position. In addition, the valve drive 1 comprises a rotatably supported control lever 13, which is drivingly connected to the cam follower 4 for controlling the valve (not shown) of the internal combustion engine.

According to FIGS. 1 and 2, the valve drive 1 further comprises a lever device 7, which is drivingly connected to the cam follower 4, for adjusting the cam follower 4 between the first and the second position. For this purpose, the valve drive 1 comprises an actuator 8, which is mechanically coupled or drivingly connected, respectively, to the lever device 7. The actuator 8 is connected to the control lever 13 or is fastened thereto, respectively, by means of an axis 14. The actuator 8 can be embodied as electrically driven actuator. In a variation, the actuator 8, however, can also be embodied as hydraulic actuator, which is supported on the axis 14 as well as on a bearing part (not shown), on which the control lever 13 is rotatably supported. Such a hydraulic actuator, however, can also be fastened directly to the axis 14.

To fasten the axis 14 to the control lever 13, the latter has a first accommodation 15*a*, in which the axis 14 is partially accommodated. In the example of the figures, the first accommodation 15*a* is embodied as first aperture 16*a*, so that the axis 14 engages through the aperture 16*a*. The control lever 13 furthermore has two second accommodations 15*b*, in which the roller bolt 5 is accommodated. The second accommodations 15*b* are in each case embodied as second aperture 16*b*, through which the roller bolt 5 engages. The direct fastening of roller bolt 5 and axis 14 on the same component, namely the control lever 13, has the result that the number of required components can be kept small.

As can furthermore be seen in FIGS. 1 and 2, the actuator 8 is connected to the cam follower 4 in an articulated manner by means of the lever device 7. The lever device 7 is thereby embodied as two-legged toggle lever 9 comprising a first leg 10*a* and comprising a second leg 10*b*. The first leg 10*a* is connected to the actuator 8 in an articulated manner by means of a first joint 11*a*. The second leg 10*b* is connected to the cam follower 4 in an articulated manner by means of a second joint 11*b*. The toggle lever 9 of the lever device 7 can be adjusted between a first lever position, in which the roller 6 of the cam follower 4 is in the first position, and a second lever position, in which the roller 6 of the cam follower 4 is in the second position.

The actuator 8 also comprises a sleeve 17, which is arranged on the axis 14 so as to be capable of being adjusted along the axial direction A. The first joint 11*a* of the lever device 7 is arranged on the sleeve 17. On the axis 14, which can be embodied as bolt, the sleeve 17 can be axially adjusted between a first sleeve position, in which the toggle lever 9 of the lever device 7 is in the first lever position, and a second sleeve position, in which the toggle lever 9 of the lever device 7 is in the second lever position. The two legs 10*a*, 10*b* are rigidly connected to one another via a toggle 12 of the toggle lever 9 and can be rotated about an axis of rotation D, which runs through the toggle 12. In the example scenario, the two legs 10*a*, 10*b* are arranged at an obtuse angle to one another in a cross section perpendicular to the axis of rotation D. An axis of rotation of the control lever 13, which is not illustrated in detail in the figures, extends along the axial direction A, thus in the drawing plane of the figures. As suggested in the figures, the axis of rotation D of the lever device 7 extends perpendicular to the axis of rotation of the control lever 13, thus perpendicular to the drawing plane of the figures.

To embody the first joint 11*a*, provision is made on the first leg 10*a* of the toggle lever 9 for a first elongated hole 18*a*. A first protrusion 19*a*, which protrudes from the sleeve 17, is adjustably guided in the first elongated hole 18*a*. To embody the second joint 11*b*, a second elongated hole 18*b* is embodied on the second leg 10*b* of the toggle lever 9. A second protrusion 19*b*, which protrudes from the roller bolt 5 of the cam follower 4, is adjustably guided in the second elongated hole 18*b*. In a variation of the example, the two legs 10*a*, 10*b* can also be realized as extendable telescopic arms of a variable length (not shown).

In this case, the provision of elongated holes 18*a*, 18*b* can be forgone. To fasten the roller bolt 5 to the control lever 13, provision is made for a second aperture 16*b* on two fork arms 21*a*, 21*b*, which are molded on the control lever 13. For this purpose, a passage opening can in each case be embodied in each fork arm 21*a*, 21*b*, wherein the two passage openings are arranged in alignment with one another along the axial direction A. A space 22, in which the roller 6, which is provided on the roller bolt 5, is arranged, is embodied between the two fork arms 21*a*, 21*b*.

According to FIG. 1, the actuator 8 comprises an actuator housing 23 as well as an actuator element 20, which protrudes from the actuator housing 23 and which can be linearly adjusted between a retracted and an extended position. The actuator element 20 and the sleeve 17 are matched to one another in such a way that the sleeve 17 is in the first sleeve position when the actuator element 20 is retracted and is in the second sleeve position when the actuator element 20 is extended, or vice versa.

If the actuator element 20 is adjusted from the retracted position shown in FIG. 1 into the extended position, an axial adjustment of the sleeve 17 on the axis along the axial direction A is associated therewith. The sleeve 17 is thereby adjusted from the first sleeve position into the second sleeve position. A rotational movement of the toggle lever 9 of the lever device 7 about the axis of rotation D is associated with the axial movement of the sleeve 17. This leads to a linear movement of the roller bolt 5, including the roller 6 relative to the cam shaft 2, so that the roller 6 of the cam follower 4 is adjusted from the first into the second position. Analogously, an adjustment of the actuator element 20 from the extended into the retracted position effects an adjustment of the roller 6 of the cam follower 4 from the second into the first position. The adjustment movements of actuator element 20, sleeve 17, toggle lever 9, roller bolt 5 and roller 6 is illustrated schematically in FIG. 1 by arrows 24.

The actuator element 20 can also be embodied as annular component and can be positioned or supported, respectively, directly on the axis 14. Due to the axially parallel position to the sleeve 17, this embodiment leads to a reduction of the transverse forces onto said sleeve; a guide, which has a reduced bearing clearance thereof, is thus possible.

The invention claimed is:

1. A valve drive for an internal combustion engine, comprising:

a cam shaft including at least two cams rotationally attached thereto;

a cam follower including a roller bolt and a rotatable roller arranged on the roller bolt;

a lever device drivingly connected to the cam follower configured to adjust the cam follower between a first position, in which the cam follower is drivingly connected to a first cam of the at least two cams, and a second position, in which the cam follower is drivingly connected to a second cam of the at least two cams;

a rotatably supported control lever drivingly connected to the cam follower via an accommodation of the rotatably supported control lever; and a linear actuator drivingly connected to the lever device configured to adjust the cam follower between the first position and the second position;

wherein the linear actuator is connected to the cam follower in an articulated manner via the lever device.

2. The valve drive according to claim 1, wherein the linear actuator and the rotatably supported control lever are supported on an axis.

3. The valve drive according to claim 1, wherein the rotatably supported control lever includes a further accommodation, in which an axis is at least partially accommodated.

4. The valve drive according to claim 3, wherein the further accommodation is an aperture which the axis engages.

5. The valve drive according to claim 1, wherein the lever device is a two-legged toggle lever including a first leg and a second leg, wherein the first leg and the second leg are rigidly connected to one another via a toggle of the two-legged toggle lever and are pivotable about an axis of rotation extending through the two-legged toggle lever.

6. The valve drive according to claim 5, wherein at least one of i) the first leg is connected to the linear actuator in an articulated manner via a first joint and ii) the second leg is connected to the cam follower in an articulated manner via a second joint.

7. The valve drive according to claim 6, wherein:

the linear actuator is supported on an axis;

the linear actuator includes a sleeve arranged on the axis such that the sleeve is adjustable in an axial direction; and the first joint is attached to the sleeve.

8. The valve drive according to claim 7, wherein an axis of rotation of the rotatably supported control lever extends along the axial direction.

9. The valve drive according to claim 7, wherein the sleeve is axially adjustable on the axis between a first sleeve position, in which the lever device is in a first lever position, and a second sleeve position, in which the lever device is in a second lever position.

10. The valve drive according to claim 9, wherein the linear actuator includes an actuator housing and an actuator element protruding from the actuator housing, the actuator element adjustable between a retracted position and an extended position, and wherein the actuator element and the sleeve are configured such that when the sleeve is in the first sleeve position the actuator element is in one of the retracted position and the extended position and when the sleeve is in the second sleeve position the actuator element is in the other of the retracted position and the extended position.

11. The valve drive according to claim 6, wherein the first joint is structured as an elongated hole disposed on the first leg, and wherein a protrusion protruding from the sleeve is adjustably arranged within the elongated hole.

12. The valve drive according to claim 6, wherein the second joint is structured as an elongated hole disposed on the second leg, and wherein a protrusion protruding from the cam follower is adjustably arranged within the elongated hole.

13. The valve drive according to claim 1, wherein the accommodation of the rotatably supported control lever has an aperture through which the roller bolt engages.

14. The valve drive according to claim 13, wherein the accommodation of the rotatably supported control lever includes two fork arms defining the aperture through which the roller bolt engages, and wherein the two fork arms of the rotatably supported control lever define a space therebetween in which the roller is arranged.

15. The valve drive according to claim 5, wherein the first leg and the second leg are arranged at an obtuse angle to one another in a cross section extending perpendicular to the axis of rotation.

16. The valve drive according to claim 1, wherein the lever device is adjustable between a first lever position, in which the cam follower is in the first position, and a second lever position, in which the cam follower is in the second position.

17. The valve drive according to claim 1, wherein an axis of rotation of the lever device extends perpendicular to an axis of rotation of the rotatably supported control lever.

18. The valve drive according to claim 1, wherein the roller is arranged on the roller bolt such that the roller is rotationally adjustable relative thereto, and the roller and the roller bolt are adjustable jointly along an axial direction of the roller bolt between the first position of the cam follower, in which the roller is drivingly connected to the first cam, and the second position of the cam follower, in which the roller is drivingly connected to the second cam.

19. The valve drive according to claim 1, wherein the rotatably supported control lever has two accommodations that drivingly connect the rotatably supported control lever to the cam follower, the two accommodations structured and arranged to receive the roller bolt.

20. An internal combustion engine comprising a valve drive including:

a cam shaft including at least two cams rotationally attached thereto;

a cam follower including a roller bolt and a rotatable roller arranged on the roller bolt;

a lever device drivingly connected to the cam follower configured to adjust the cam follower between a first position, in which the cam follower is drivingly connected to a first cam of the at least two cams, and a second position, in which the cam follower is drivingly connected to a second cam of the at least two cams;

a rotatably supported control lever drivingly connected to the cam follower configured to adjust at least one valve of an internal combustion engine via an accommodation of the rotatably supported control lever; and a linear actuator drivingly connected to the lever device configured to adjust the cam follower between the first position and the second position;

an axis structured as a bolt, the linear actuator and the rotatably supported control lever arranged on the axis;

wherein the linear actuator is connected to the cam follower in an articulated manner via the lever device.

* * * * *